US008556276B2

(12) United States Patent
Bengtzen

(10) Patent No.: US 8,556,276 B2
(45) Date of Patent: Oct. 15, 2013

(54) CONVERTIBLE AID CART

(75) Inventor: Troy Bengtzen, Holladay, UT (US)

(73) Assignee: Troy Bengtzen, Holladay, UT (US)

( * ) Notice: Subject to any disclaimer, the term of this patent is extended or adjusted under 35 U.S.C. 154(b) by 0 days.

(21) Appl. No.: 13/545,893

(22) Filed: Jul. 10, 2012

(65) Prior Publication Data

US 2013/0015629 A1 Jan. 17, 2013

Related U.S. Application Data

(60) Provisional application No. 61/507,978, filed on Jul. 14, 2011.

(51) Int. Cl.
*B62B 1/04* (2006.01)

(52) U.S. Cl.
USPC .... 280/30; 280/47.18; 280/47.33; 280/47.26; 206/216; 190/11

(58) Field of Classification Search
USPC ..... 280/30, 47.18, 47.26, 47.33, 47.31, 280/278, 287, 418.1, 653; 135/87, 88.01, 135/88.02; 206/216; 190/11, 12 A, 12 R, 190/18 A; 248/534, 512, 513, 535, 68.1, 248/501–503, 507, 508; 211/60.1
See application file for complete search history.

(56) References Cited

U.S. PATENT DOCUMENTS

| | | | | |
|---|---|---|---|---|
| 2,394,245 | A * | 2/1946 | Koller | 5/627 |
| 4,147,369 | A * | 4/1979 | Simpson | 280/30 |
| 4,316,615 | A * | 2/1982 | Willette | 280/47.26 |
| 4,729,574 | A * | 3/1988 | Tipke | 280/415.1 |
| 4,991,716 | A * | 2/1991 | Havlovitz | 206/335 |
| 5,285,936 | A | 2/1994 | Matricardi, Jr | |
| 5,380,022 | A * | 1/1995 | Dennis | 280/47.35 |
| 5,653,457 | A * | 8/1997 | Marmer et al. | 280/30 |
| 5,806,866 | A * | 9/1998 | Fleischer | 280/47.31 |
| 6,217,043 | B1 | 4/2001 | Chumley | |
| 6,241,276 | B1 * | 6/2001 | Wilburn | 280/659 |
| 6,345,638 | B1 * | 2/2002 | Warner | 135/123 |
| 6,454,340 | B1 * | 9/2002 | Miller et al. | 296/104 |
| 7,226,072 | B2 * | 6/2007 | Shapiro | 280/653 |
| 7,284,763 | B1 * | 10/2007 | King | 280/47.26 |
| 7,818,840 | B2 | 10/2010 | Barnett et al. | |
| 2003/0209886 | A1 | 11/2003 | Darling, III | |
| 2004/0256838 | A1 * | 12/2004 | Shapiro | 280/653 |
| 2007/0029760 | A1 * | 2/2007 | Darling | 280/640 |
| 2010/0032927 | A1 * | 2/2010 | Gordon | 280/659 |

FOREIGN PATENT DOCUMENTS

| | | | | |
|---|---|---|---|---|
| DE | 3123440 | A1 * | 7/1983 | B62B 3/02 |

* cited by examiner

*Primary Examiner* — John R Olszewski
*Assistant Examiner* — Steve Clemmons
(74) *Attorney, Agent, or Firm* — Michael F. Krieger; Kirton McConkie

(57) ABSTRACT

The present invention is directed to an aid cart for storing and transporting emergency or other supplies. The aid cart serves as a transportable storage container and is convertible into various configurations that can be used to provide first responder aid and relief, and transforms into various tools to help clean-up and rebuild after a disaster has occurred. In this manner, the aid cart enables victims to quickly care for themselves, their families, and their neighbors, and encourages victims to immediately begin the clean-up and rebuilding process. The aid cart is convertible into different configurations using various tubes. Hub brackets on either side of the aid cart include adapters to which any of the tubes can be connected. The tubes can be connected to the adapters to form different configurations.

23 Claims, 17 Drawing Sheets

CONVERTIBLE AID CART

CROSS-REFERENCE TO RELATED APPLICATIONS

This application claims priority to U.S. Provisional Patent Application No. 61/507,978, titled Mobile Adaptable Survival Container, which was filed on Jul. 14, 2011.

BACKGROUND

When a disaster occurs, whether natural or man-made, the injury and death toll often depends on how quickly emergency supplies can be delivered to the victims of the disaster. Oftentimes, victims rely on emergency responders outside the disaster zone to supply the necessary supplies. These emergency responders, in some cases, may not be able to reach many victims in a timely fashion such as when the disaster is of great magnitude or widely spread.

For example, if a large number of people are in need of emergency supplies, the supplies available within close proximity of a disaster may not be adequate to treat each victim. Similarly, even if adequate supplies exist within close proximity, it may be difficult or impossible to transport the supplies to those in need.

BRIEF SUMMARY

The present invention is directed to an aid cart for storing and transporting emergency or other supplies. The aid cart serves initially as a transportable storage container and is convertible into various devices that can be used to sustain life, and begin to clean-up and rebuild after a disaster has occurred. In this manner, the aid cart enables victims to quickly care for themselves, their families, and their neighbors, and encourages victims to immediately begin the clean-up and rebuilding process.

The aid cart can be used to store emergency or other supplies that are necessary or useful in an emergency situation. The aid cart allows these supplies to be packed into a single container having a small footprint that can be positioned in virtually any location where it will be most easily accessible in the event of an emergency. Further, the aid cart is portable to allow the supplies to be transported more easily, and is convertible into various devices that can be used in the emergency response or cleanup. In some embodiments, the aid cart can be sized to fit onto a standard shipping pallet and be stackable to allow for mass distribution of the aid carts by humanitarian service organizations.

The various devices into which the emergency cart can be converted provide many immediately accessible tools for use during and after an emergency event to assist in sustaining life, providing relief, cleaning up, rebuilding, etc. These tools and supplies contained within the aid cart also help victims maintain a semblance of normalcy in the event of an emergency.

The aid cart can also be used outside of emergency situations such as for commercial or recreational purposes. In short, the aid cart of the present invention can be used as a compact, portable storage unit for virtually any supplies, and converted into various different devices for use in many different scenarios.

In one embodiment, an aid cart comprises a shell having a set of wheels and a lid, a plurality of tubes, and a pair of hub brackets attached on opposing sides of the shell. Each hub bracket includes an adapter configured to allow any of the tubes to be attached to the adapter on either a top or a bottom end of the adapter.

Each hub bracket also has at least one hole through which a tube can be inserted. Each pair of hub brackets is aligned on the corresponding side of the shell so that one or more tubes can be stored along the surface of the shell by inserting each tube through a corresponding hole in each hub bracket.

In another embodiment, a convertible aid cart comprises a shell having a sled shape with a set of wheels attached on one end, and a lip extending along a top edge of the sides, a plurality of interchangeable tubes, and a pair of hub brackets attached on opposing sides of the shell. Each pair of hub brackets is configured with corresponding holes for storing at least one of the interchangeable tubes.

Each hub bracket also includes an adapter in a substantially vertical orientation that is configured on both the top and the bottom end to receive any of the interchangeable tubes. Each of the hub brackets is positioned on the sides of the shell so that an opening is formed between the lip and the hub bracket into which any of the interchangeable tubes can be inserted to form a handle for the convertible aid cart.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
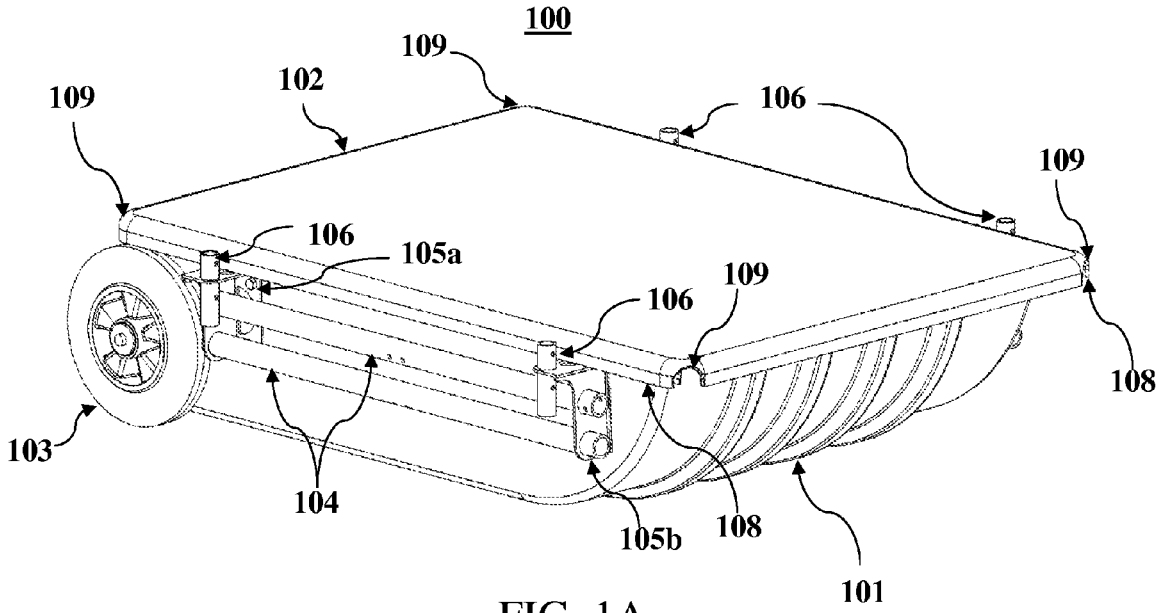
FIGS. 1A-1B illustrate an aid cart according to one or more embodiments of the invention.

The present invention is directed to an aid cart for storing and transporting emergency or other supplies. The aid cart serves initially as a transportable storage container and is convertible into various devices that can be used to sustain life, and begin to clean-up and rebuild after a disaster has occurred. In this manner, the aid cart enables victims to quickly care for themselves, their families, and their neighbors, and encourages victims to immediately begin the clean-up and rebuilding process.

The aid cart can be used to store emergency or other supplies that are necessary or useful in an emergency situation. The aid cart allows these supplies to be packed into a single container having a small footprint that can be positioned in virtually any location where it will be most easily accessible in the event of an emergency. Further, the aid cart is portable to allow the supplies to be transported more easily, and is convertible into various devices that can be used in the emergency response or cleanup. In some embodiments, the aid cart can be sized to fit onto a standard shipping pallet and be stackable to allow for mass distribution of the aid carts by humanitarian service organizations.

The various devices into which the emergency cart can be converted provide many immediately accessible tools for use during and after an emergency event to assist in sustaining life, providing relief, cleaning up, rebuilding, etc. These tools and supplies contained within the aid cart also help victims maintain a semblance of normalcy in the event of an emergency.

The aid cart can also be used outside of emergency situations such as for commercial or recreational purposes. In short, the aid cart of the present invention can be used as a compact, portable storage unit for virtually any supplies, and converted into various different devices for use in many different scenarios.

In one embodiment, an aid cart comprises a shell having a set of wheels and a lid, a plurality of tubes, and a pair of hub brackets attached on opposing sides of the shell. Each hub bracket includes an adapter configured to allow any of the tubes to be attached to the adapter on either a top or a bottom end of the adapter.

Each hub bracket also has at least one hole through which a tube can be inserted. Each pair of hub brackets is aligned on the corresponding side of the shell so that one or more tubes can be stored along the surface of the shell by inserting each tube through a corresponding hole in each hub bracket.

In another embodiment, a convertible aid cart comprises a shell having a sled shape with a set of wheels attached on one end, and a lip extending along a top edge of the sides, a plurality of interchangeable tubes, and a pair of hub brackets attached on opposing sides of the shell. Each pair of hub brackets is configured with corresponding holes for storing at least one of the interchangeable tubes.

Each hub bracket also includes an adapter in a substantially vertical orientation that is configured on both the top and the bottom end to receive any of the interchangeable tubes. Each of the hub brackets is positioned on the sides of the shell so that an opening is formed between the lip and the hub bracket into which any of the interchangeable tubes can be inserted to form a handle for the convertible aid cart.

Figure 1B:
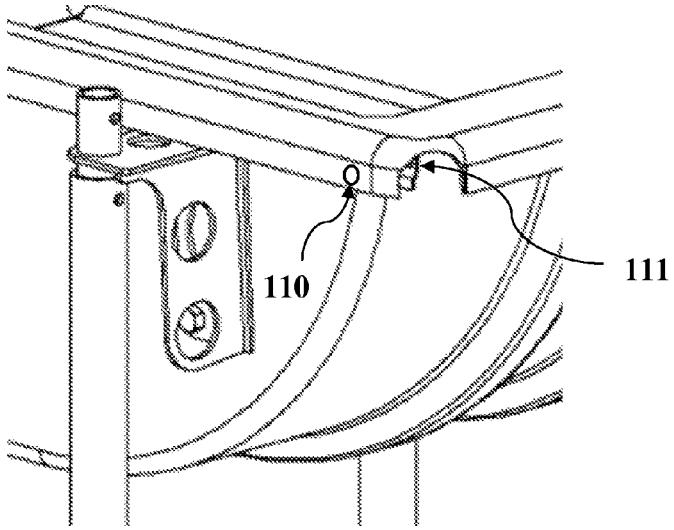

FIGS. 1A-1B illustrate an exemplary aid cart 100 according to one or more embodiments of the invention. Aid cart 100 comprises shell 101, lid 102, wheel assembly 103, tubes 104, hub brackets 105*a-b*, and adapters 106. Shell 101 forms a mobile container for containing emergency or other supplies. Lid 102 can form a water or airtight seal when attached to shell 101 to protect the supplies (such as when aid cart 100 is stored outdoors). Shell 101 and lid 102 can be made of plastic (e.g. polyethylene), metal, composites, or any other suitable material. Although FIG. 1 illustrates shell 101 as having a sled shape, shells of other concave shapes can also be used.

In some embodiments, the materials used for shell 101 can be resistant to the elements, including UV rays and extreme ranges of heat and cold, as well as extreme forces. Shell 101 can also be manufactured with a reflective coating to increase its visibility. In some embodiments, aid cart 100 can include (e.g. have embedded or be connected to) one or more digital electronic devices such as intermediate frequency receiver chips, global position system devices, emergency radio receivers, etc. In some embodiments, shell 101 can include one or more drains to control the inflow/outflow of fluids. Such drains can include a removable drain plug for selectively sealing the drain. Aid cart 100 can also include one or more instructions, diagrams, or photographs attached thereto which describe how to use each feature of aid cart 100.

Wheel assembly 103 comprises two wheels and an axle that extends through or otherwise attaches to shell 101. Wheel assembly 103 enables aid cart 100 to be easily transported, and enables the conversion of shell 101 into various other devices as will be further described below.

Hub brackets 105*a-b* store tubes 104 while tubes 104 are not in use. Aid cart 100 includes two sets of hub brackets 105*a-b*, one on two opposing sides of the cart. As shown, a set of hub brackets 105*a-b* secures one or more tubes 104 to aid cart 100. The opposite side of aid cart 100, which is not shown in FIG. 1, is likewise configured with a set of hub brackets 105*a-b* that secures one or more tubes 104. In the remainder of the description, the hub brackets may be referred to generally as hub brackets 105. Although hub brackets 105 shown in the Figures are configured to secure two tubes 104, hub brackets 105 could be configured to store one or more tubes in some embodiments.

Adapters 106, in some embodiments, are integrated into hub brackets 105 (e.g. as a single molded part, or by welding). In other embodiments, adapters 106 are separate and removable from hub brackets 105. Adapters 106 can be used to attach tubes 104 to hub brackets 105 in various configurations as will be further described below.

Each of tubes 104 can be of the same diameter and length to allow interchangeable use of tubes 104 in the various configurations described below. Each of tubes 104 includes various holes for attaching the tube using a pin in these various configurations.

Shell 101 further includes a lip 108 along the top of both sides. Lip 108 comprises a curved protrusion of shell 101 along the top edge as is shown in FIG. 1. Lip 108 can be formed along all of the sides of shell 101 as shown in FIG. 1, or alternatively, could be formed along only two opposing sides of shell 101.

Each lip 108 includes an opening 109 on both ends through which a tube 104 can be inserted to form a handle as will be further described below. Accordingly, a handle can be formed using any of tubes 104, in a similar manner, at all four lip corners of shell 101.

Figures 2A, 2B:
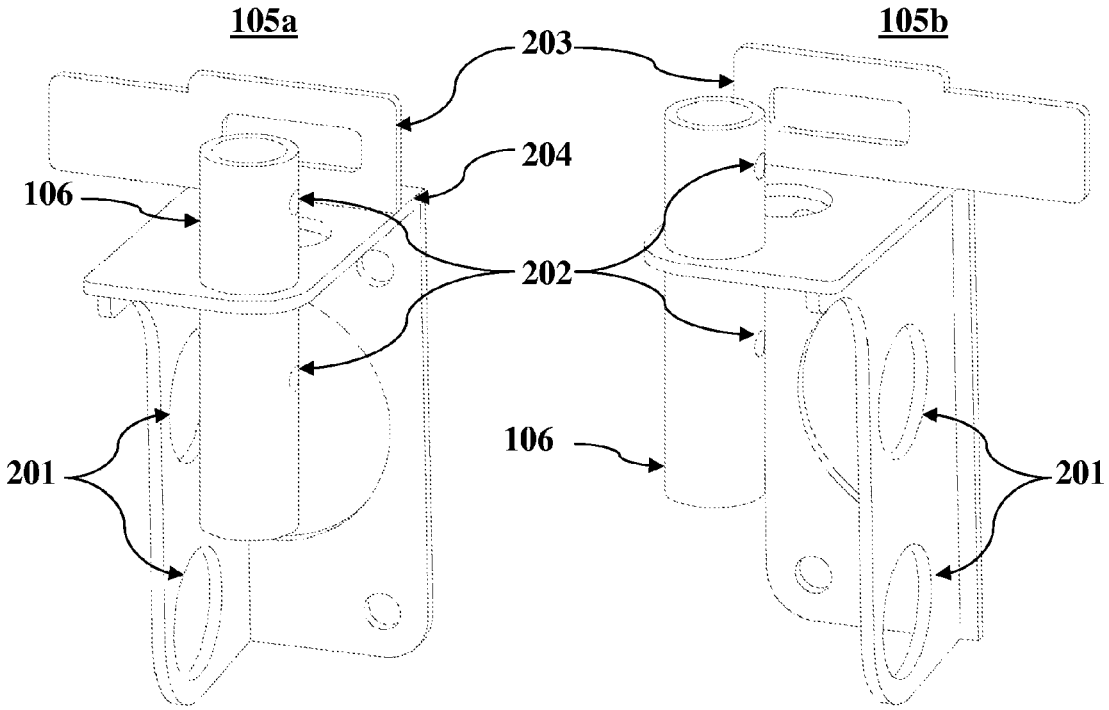
FIGS. 2A-2B illustrate exemplary hub brackets that are attached to the aid cart of FIG. 1.

Hub brackets 105 are attached to shell 101 so that the spacing between the hub brackets and lip 108 are sufficient to receive tubes 104 when inserted through openings 109. For example, as shown in FIGS. 2A-2B, when the hub bracket is attached to shell 101, portions 203 and 204 (only visible on hub bracket 105*a*) of the hub bracket form an opening between the hub bracket and lip 108 into which tubes 104 can be inserted. Portions 203 and 204 together with lip 108 prevent tubes 104 from moving outwardly away from shell 101, or upwardly or downwardly along the exterior of shell 101 respectively, thus providing great strength to tubes 104 when used as handles as further described below.

A pin (not shown) may be used to secure the position of tubes 104 when inserted into the opening formed between hub bracket 105 and lip 108. For example, as shown in FIG. 1B, lip 108 may include a hole 110 near opening 109 through which the pin is inserted (each corner of lips 108 can have a similar hole). A corresponding receptacle 111 for the pin may be attached to or formed within shell 101. Tubes 104 may also include corresponding holes so that the pin can extend through hole 110 and tube 104 and into or through receptacle 111 to further secure tube 104 when used as a handle. In some embodiments, the pin can also be used to secure lid 102 to shell 101 (e.g. when lid 102 includes a corresponding hole though which the pin can be inserted).

In some embodiments, shell 101 can include connection points, such as holes, grommets, rivets, cutouts, pins, bars, inserts, etc. to which straps, ropes, handles, harnesses, chains, webbing, etc. can be connected to assist with transporting aid cart 100 or shell 101 (e.g. by human or mechanical power). Such connection points can also be used to store aid cart 100. For example, the connection points can be used to mount aid cart 100 under an eave of a house, under the ceiling of a garage, on the side of a shed, along the rail of a ship, on the top of a car, etc.

FIGS. 2A and 2B illustrates hub brackets 105*a* and 105*b* with adapters 106 respectively. Each of hub brackets 105*a* and 105*b* includes two holes 201 through which tubes 104 are inserted to store tubes 104 when not in use. Tubes 104 can be maintained within holes 201 by inserting pins through holes on both ends of tubes 104 thus preventing the end from sliding out through hole 201. Adapters 106 are shown as including holes 202 for receiving a pin or other connector for securing tubes 104 to adapters 106. Of course, other means may be used to connect tubes 104 to adapters 106. However, by using pins that extend through tubes 104, the same holes and pins can be used to attach tubes 104 to shell 101 as handles, to attach tubes 104 to either end of adapters 106, to secure tubes 104 within hub brackets 105 for storage, etc.

Figure 3A:
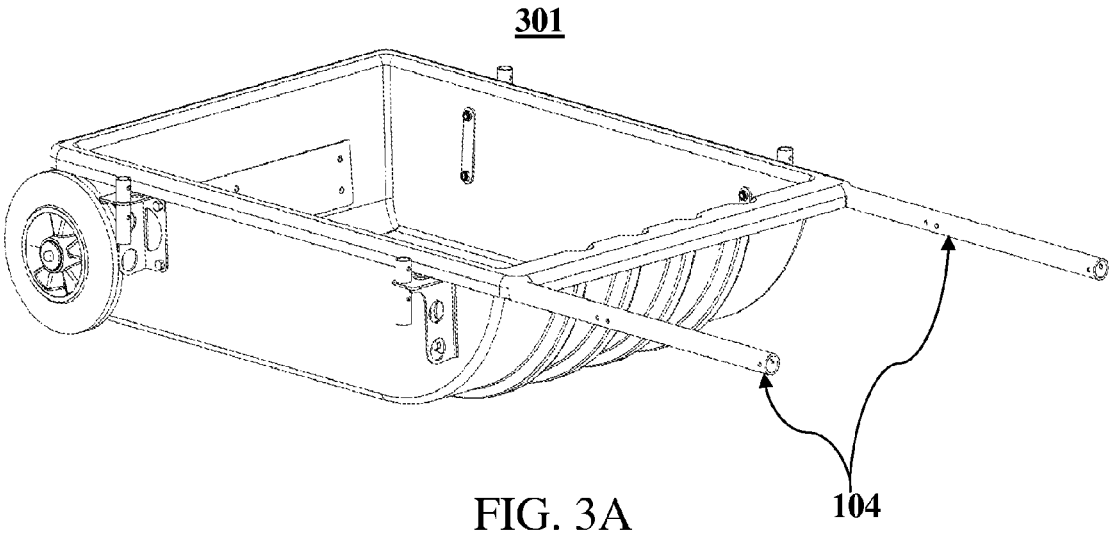
FIGS. 3A-3D illustrate various tube configurations for converting the aid cart into various devices.

FIG. 3A illustrates aid cart 100 when converted into a wheeled cart 301. As shown, to convert aid cart 100 into wheeled cart 301, two tubes 104 are connected to hub brackets 105 and shell 101 to form handles by inserting the tubes into opening 109 and into the opening formed between the hub brackets and lip 108. The tubes can be held in place using a pin as described above with respect to FIG. 1B.

In FIG. 3A, wheeled cart 301 is shown without lid 102 or any contents. In this configuration, wheeled cart 301 can be used similar to a wheelbarrow for transporting various types of materials, objects, or even people. However, the aid cart 100 can be converted into wheeled cart 301 even when lid 102 is in place, and the emergency or other supplies may or may not be contained inside shell 101. With lid 102 in place, items can also be transported on top of lid 102. In this manner, the transport of the items is facilitated.

Figure 3B:
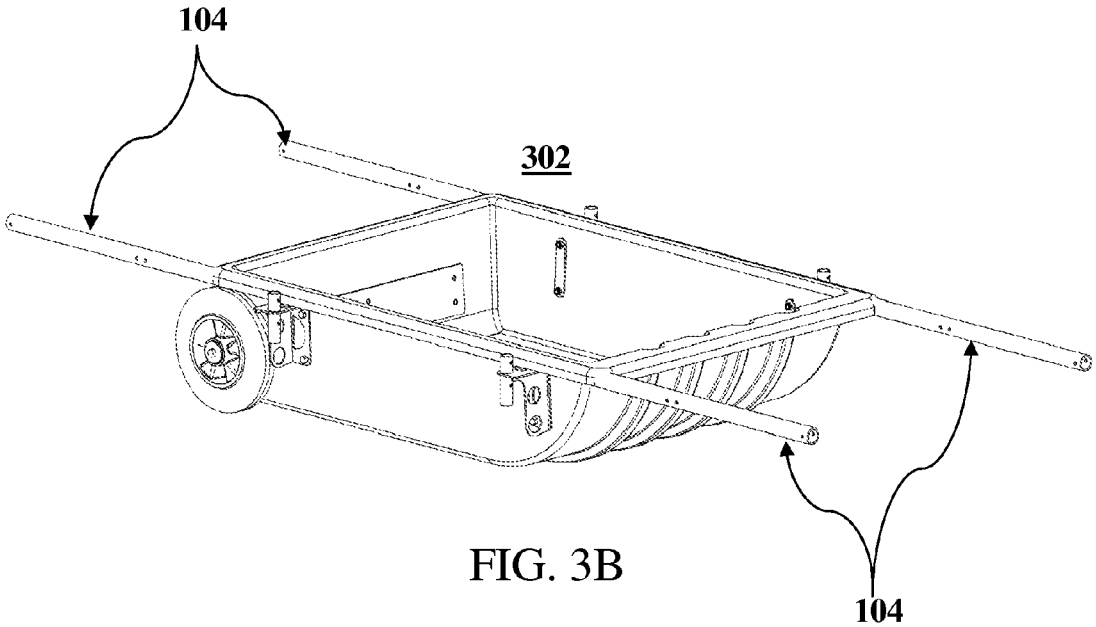

FIG. 3B illustrates aid cart 100 when converted into a two-person carrier 302. Two-person carrier 302 is similar to wheeled cart 301 with the addition of two additional tubes 104 as shown. These two additional tubes 104 are connected to shell 101 as described above thus providing handles on opposite ends of aid cart 100 to allow two people to carry aid cart 100 with any contents. Two-person carrier 302 can be used to carry any type of material, object, or even people (i.e. two-person carrier 302 can serve as a stretcher for transporting victims). As with wheeled cart 301, the aid cart 100 can be converted into two-person carrier 302 even when lid 102 is in place and the emergency or other supplies may or may not be contained inside shell 101. Items can also be carried on top of lid 102 in this configuration.

Figure 3C:
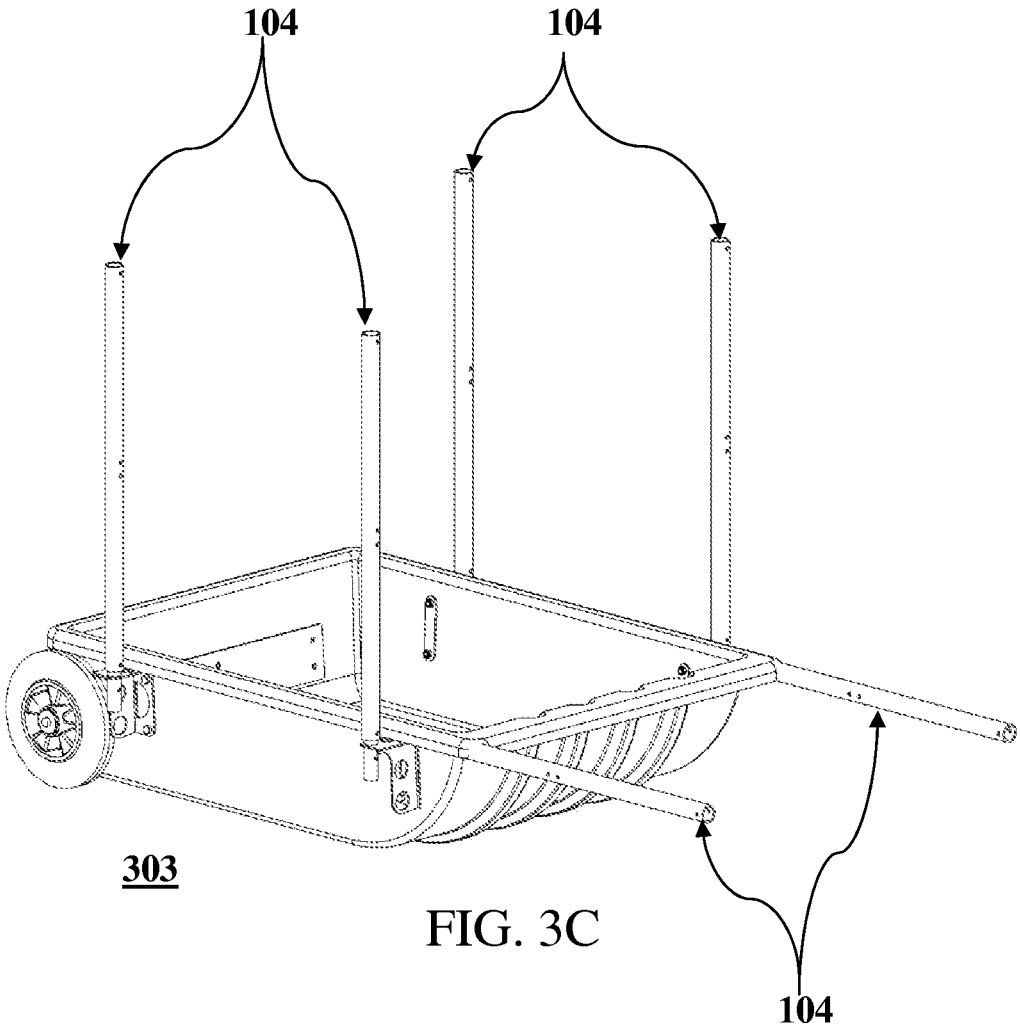

FIG. 3C illustrates aid cart 100 when converted into a stake-side bulk carrier 303. Stake-side bulk carrier 303 is similar to wheeled carrier 301 with the addition of four tubes 104 that are connected to adapters 106 (e.g. using pins) in a vertical position/orientation. In this configuration, tubes 104 provide support for maintaining bulk items within bulk carrier 303 during transport. The two additional tubes 104 used to convert aid cart 100 into stake-side bulk carrier 303 can be stored inside shell 101, and may be included in the emergency supplies initially contained within aid cart 100. On the other hand, in embodiments where hub brackets 105 are configured to store three tubes (e.g. when hub brackets 105 contain three or more holes 201), all six tubes used for stake-side bulk carrier 303 can be stored within hub brackets 105.

Figure 3D:
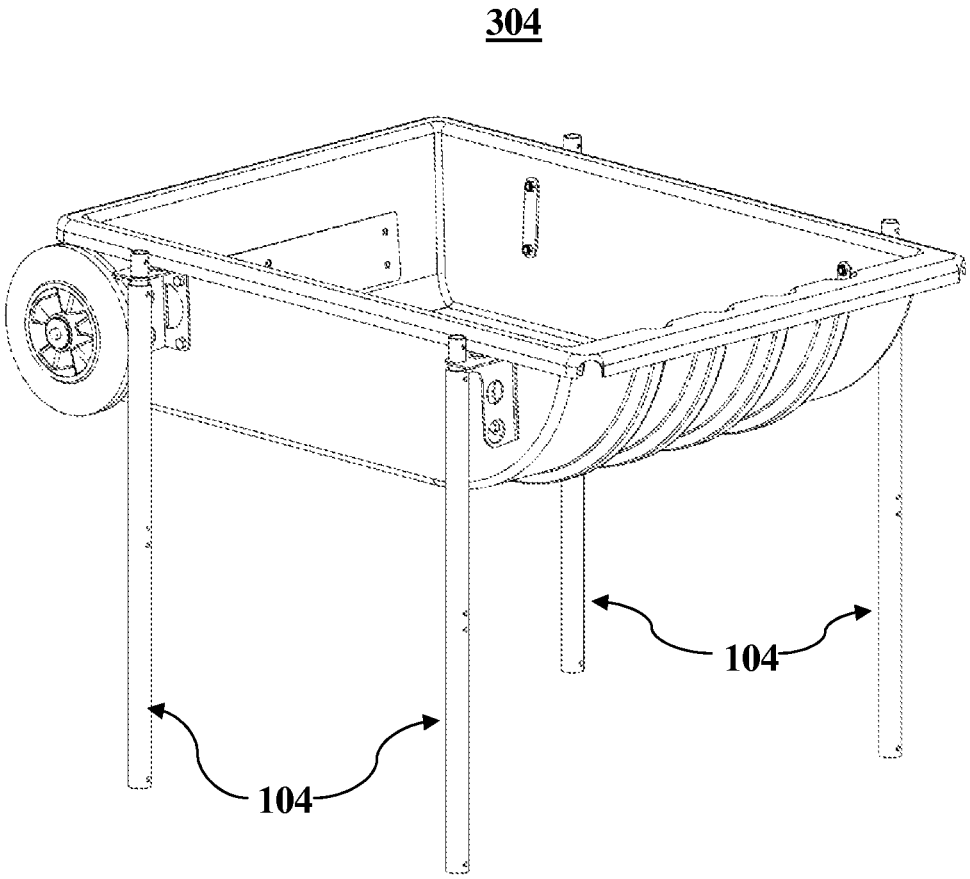

FIG. 3D illustrates aid cart 100 when converted into an elevated work area 304. To form elevated work area 304, tubes 104 are connected to adapters 106 (e.g. using pins) in a vertical downward position as shown. Accordingly, tubes 104 form the legs of elevated work area 304. In FIG. 3D, shell 101 is shown without lid 102, and therefore, elevated work area 304 forms a basin or tub. Alternatively, lid 102 could be attached to shell 101 to form a generally flat table-like surface for elevated work area 304.

Although not shown in the figures, an elevated work area can also be created by attaching tubes 104 to adapters 106 in the upward position and inverting shell 101 so that the bottom of shell 101 forms a relatively flat surface for the elevated work area. This configuration can also be used as a shelter. A lean-to type shelter could also be formed by using only two tubes 104 on one end of shell 101 in this configuration thus allowing the other end of shell 101 to rest on the ground.

Figure 4A:
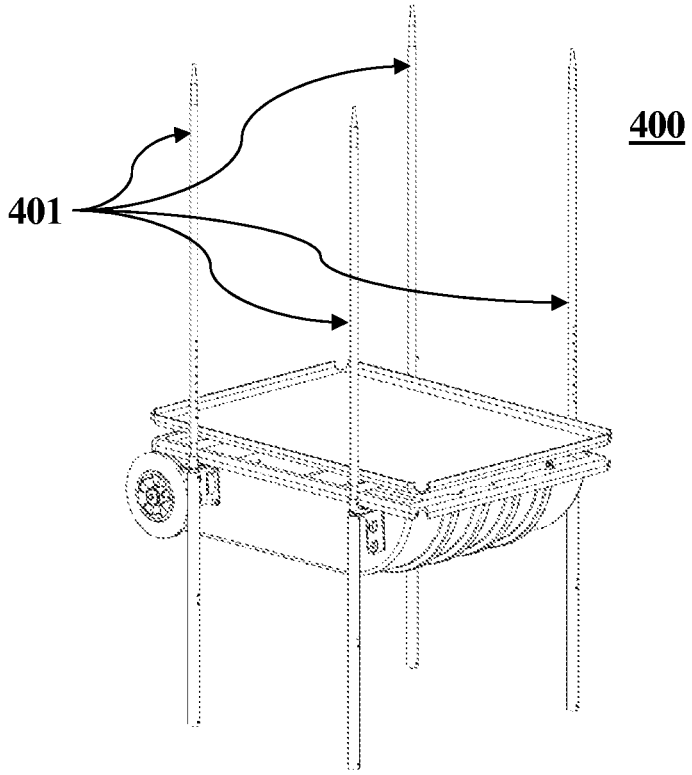
FIGS. 4A-4D illustrate a configuration of the aid cart as a covered work area.

FIGS. 4A-4D illustrate elevated work area 304 with the addition of a canopy assembly 400. Canopy assembly 400 can be contained within aid cart 100 or otherwise made available. Canopy assembly 400 can comprise telescoping tubes 401, canopy 402, ropes 403-404, and shell support bars 410. To form canopy assembly 400, as shown in FIG. 4A, telescoping tubes 401 are attached to adapters 106 to form supports for canopy 402 as shown.

Telescoping tubes 401 can attach to adapters 106 in various ways. In some embodiments, telescoping tubes 401 can be attached using pins in a similar manner as tubes 104. In other embodiments, as is shown in FIGS. 4A-4D, a pair of shell support bars 410 (identified in FIG. 4B) can be used to interconnect telescoping tubes 401 with adapters 106.

Shell support bars 410 provide rigidity to shell 101 when used in these configurations. For example, when loaded, the sides of shell 101 will tend to flex. Shell support bars 410 provide added strength and rigidity to shell 101 to enable shell 101 to remain rigid and hold a large amount of weight. Shell support bars 410 can be used in any of the disclosed configurations of shell 101 as desired to provide greater support to shell 101.

Figure 4B:
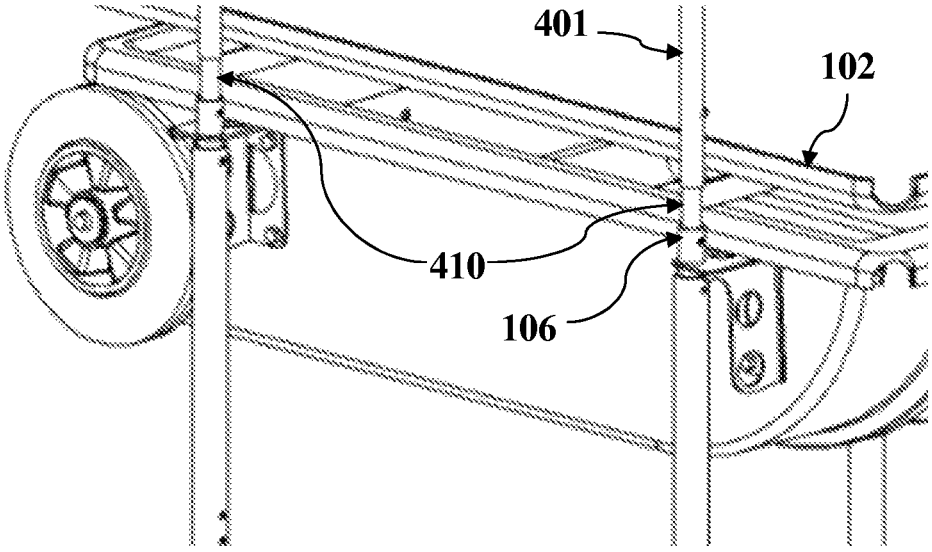

Each shell support bar 410 comprises a horizontal bar that extends between two vertical legs. The legs on either end of shell support bar 410 can have a cylindrical shape to allow the legs to be connected to adapters 106. As shown in FIG. 4B, the legs of shell support bar 410 have an outer diameter that is small enough to allow the cylinders to be inserted into adapters 106 on either side of shell 101, and to be inserted into telescoping tubes 401. In FIGS. 4A-4D, lid 102 is shown upside down on top of the horizontal portion of shell support bars 410; however, lid 102 could equally be connected in its normal position to shell 101, or removed altogether from aid cart 100.

Figure 4C:
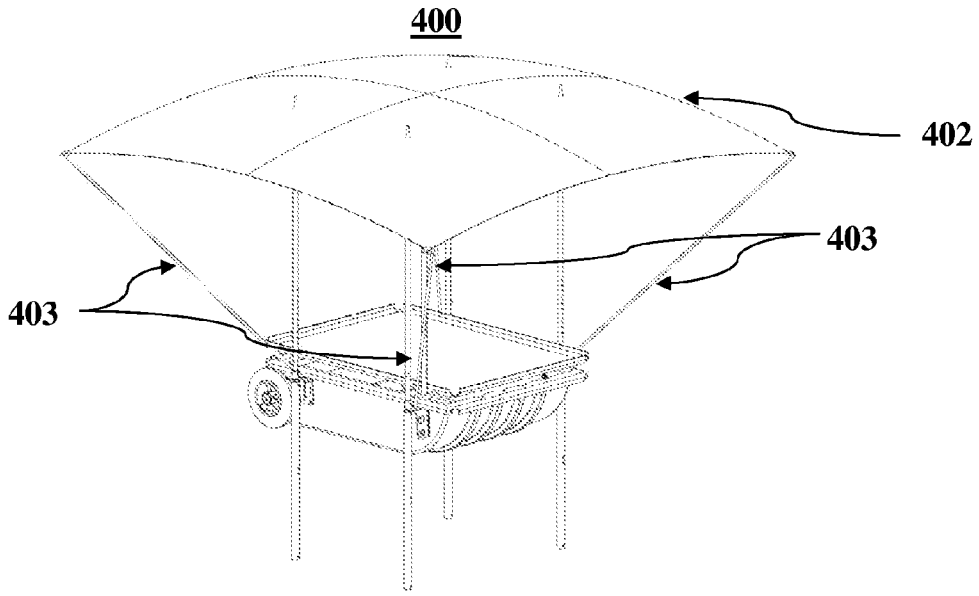

The horizontal bar of shell support bar 410 can be configured in different forms. In the Figures, the horizontal bar is shown as being straight thus giving the shell support bar a general H shape. However, in other embodiments, the horizontal bar can be in the form of a U that follows the inside contour of shell 101 when shell support bar 410 is attached to adapters 106. Alternatively, a U shaped shell support bar 410 can be designed to follow the top (i.e. exterior) contour of shell 101 as it makes the entire area of shell 101 open and accessible. Telescoping tubes 401 can be extended to allow canopy 402 to be positioned at various heights. The top of each of telescoping tubes 401 can be tapered to conform to a corresponding hole in canopy 402 so that a portion of each telescoping tube extends through canopy 402 as shown in FIG. 4C.

Figure 4D:
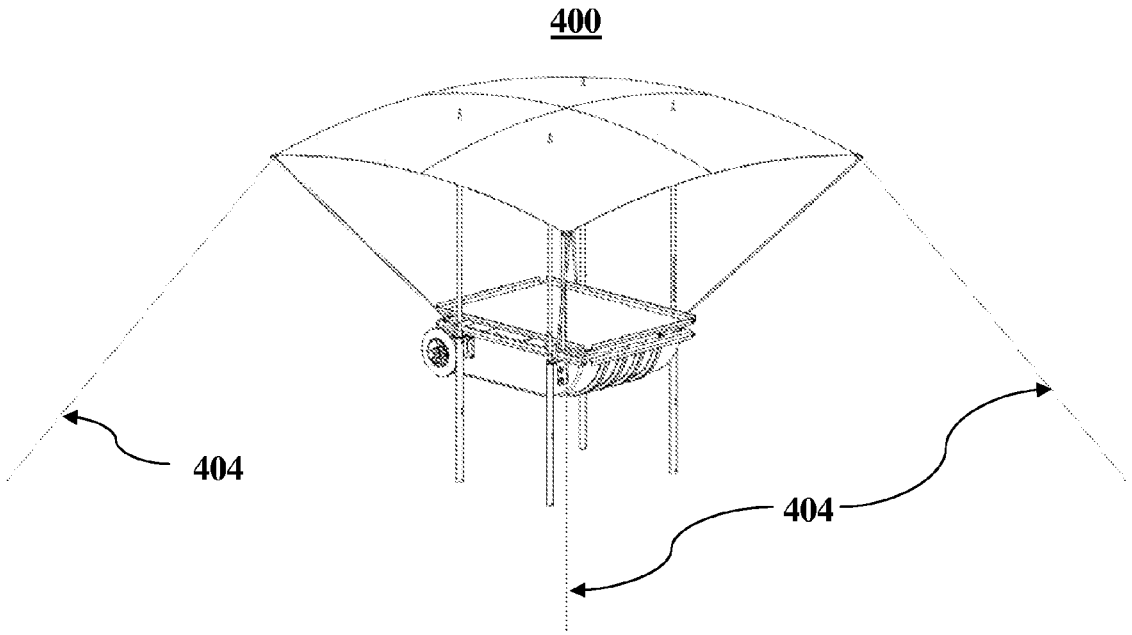

Canopy 402 can include various loops or rings to allow canopy 402 to be tied down to aid cart 100 or to the ground. FIG. 4C shows each corner of canopy 402 being tied down to aid cart 100 using ropes 403. Of course, other materials other than rope could be used to tie down canopy 402 (e.g. bungee cords). Similarly, FIG. 4D shows each corner of canopy 402 being tied down to the ground using ropes 404.

Figure 5A:
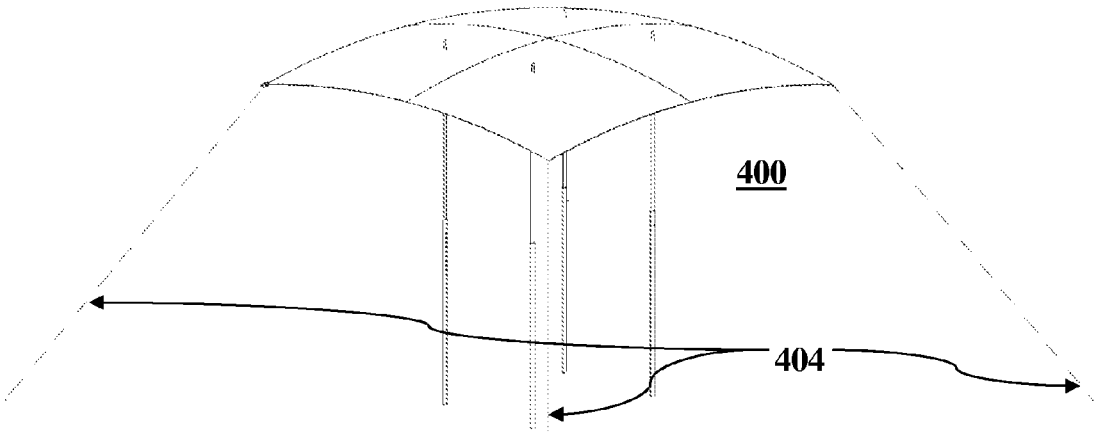
FIGS. 5A-5B illustrate a canopy that can be configured using a canopy assembly stored within the aid cart.
Figure 5B:
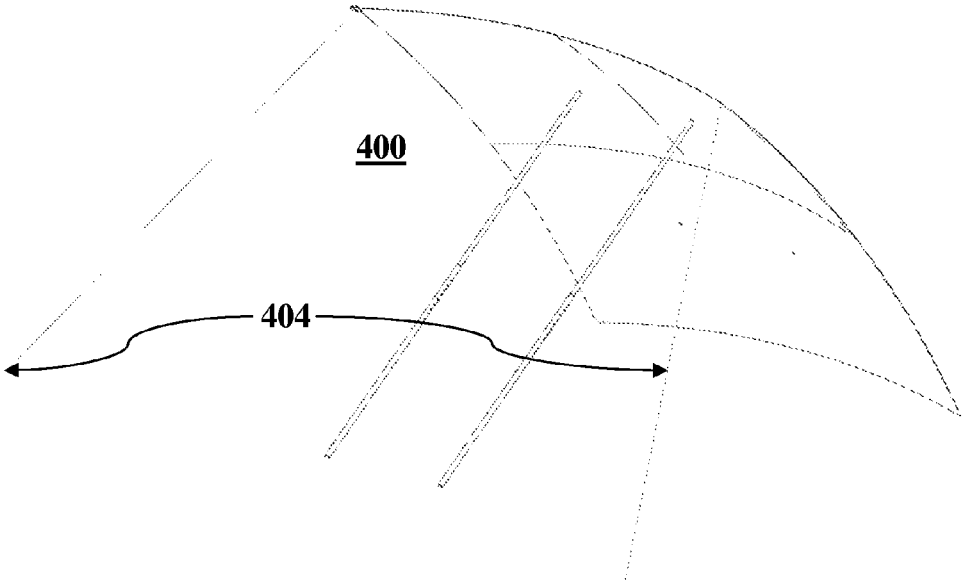

FIGS. 5A-5B illustrate canopy assembly 400 as a stand-alone unit. In some embodiments of the invention, canopy assembly 400 can be formed separately from aid cart 100. In FIG. 5A, canopy assembly 400 is shown in a generally upright position. In this configuration, telescoping tubes 401 have been extended, and ropes 404 are shown tying down canopy 402 to the ground. Canopy assembly 400 can also be used in an angled configuration as is shown in FIG. 5B. In this configuration, two telescoping tubes 401 are used thus allowing canopy 402 to tilt down to the ground. To secure canopy 402 in this configuration, the elevated corners of canopy 402 are tied down using ropes 404.

FIGS. 6A-6I illustrate aid cart 100 when converted into a cart 600. Cart 600 is formed using tubes 104 in conjunction with forks 601 and yoke bracket 603. Forks 601 are similar to standard bicycle forks, but are configured on the top end to connect to adapters 106 in the same manner as tubes 104 connect to adapters 106. Additionally, each of forks 601 contains multiple notches 602 for receiving a bicycle wheel axle. Notches 602 are spaced vertically along forks 601 to allow different sized wheels to be used including allowing a different sized wheel to be used on each side of cart 600.

A first set of tubes 104 are connected to adapters 106 to form legs for cart 600. Another set of tubes 104 (labeled 104*a* and 104*b*) are attached to shell 101 as handles. Yoke bracket 603 is connected between tubes 104*a* and 104*b* to form a handle for pushing or pulling cart 600. Cart 600 can be configured with or without canopy assembly 400, shell support bars 410, yoke bracket 603, and lid 102 as represented in FIGS. 6A-6I.

FIGS. 6B, 6C, 6E, 6F, and 6H illustrate how notches 602 enable wheels of different sizes to be used. For example, two wheels of the same size may not be available in all situations. Cart 600 accordingly can be used with virtually any two wheels by positioning each wheel in the appropriate notch 602 so that cart 600 is level.

Figure 6A:
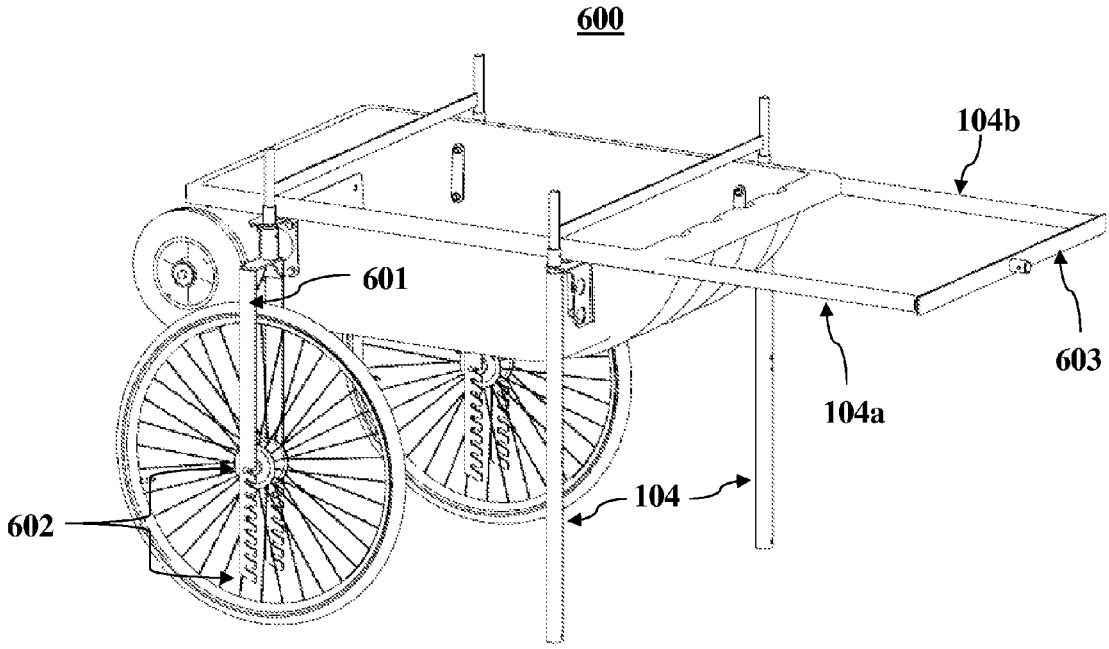
FIGS. 6A-6I illustrate a configuration of the aid cart as a coverable cart or trailer.
Figure 6B:
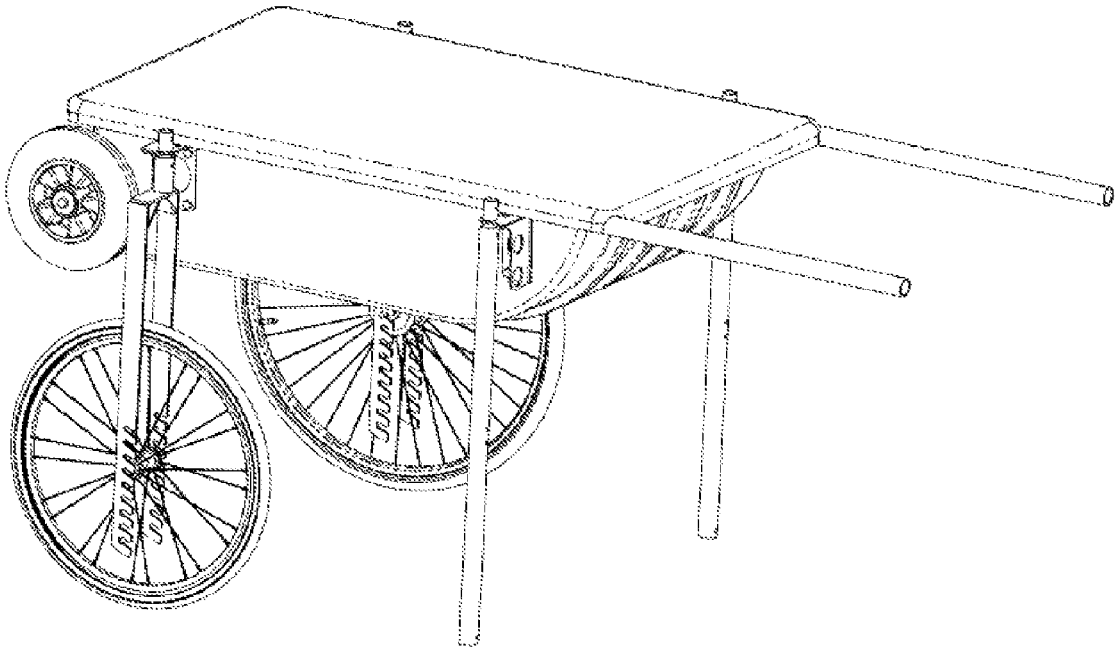
Figure 6C:
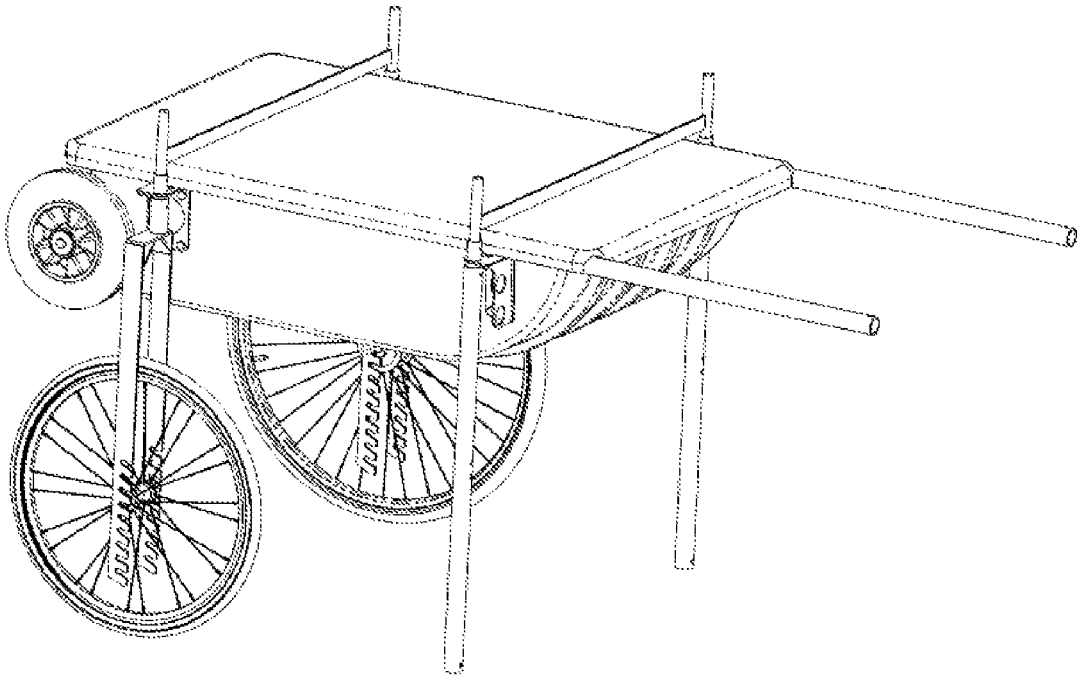
Figure 6D:
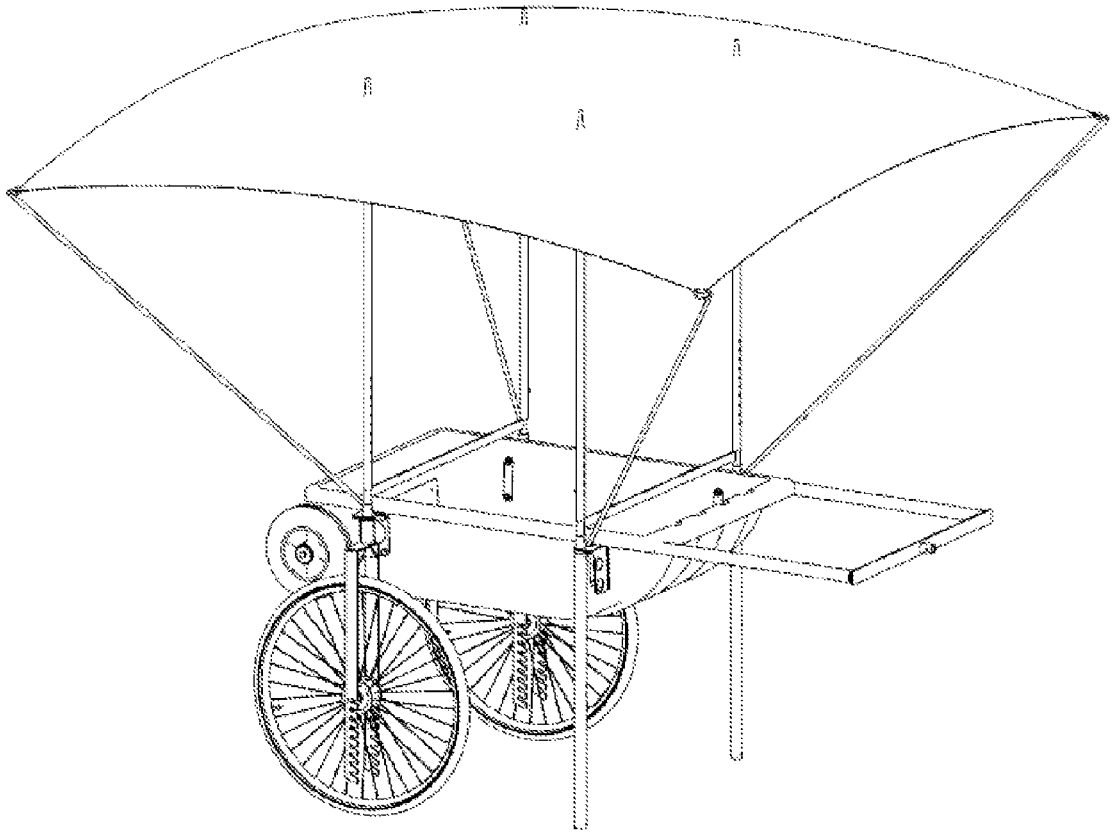
Figure 6E:
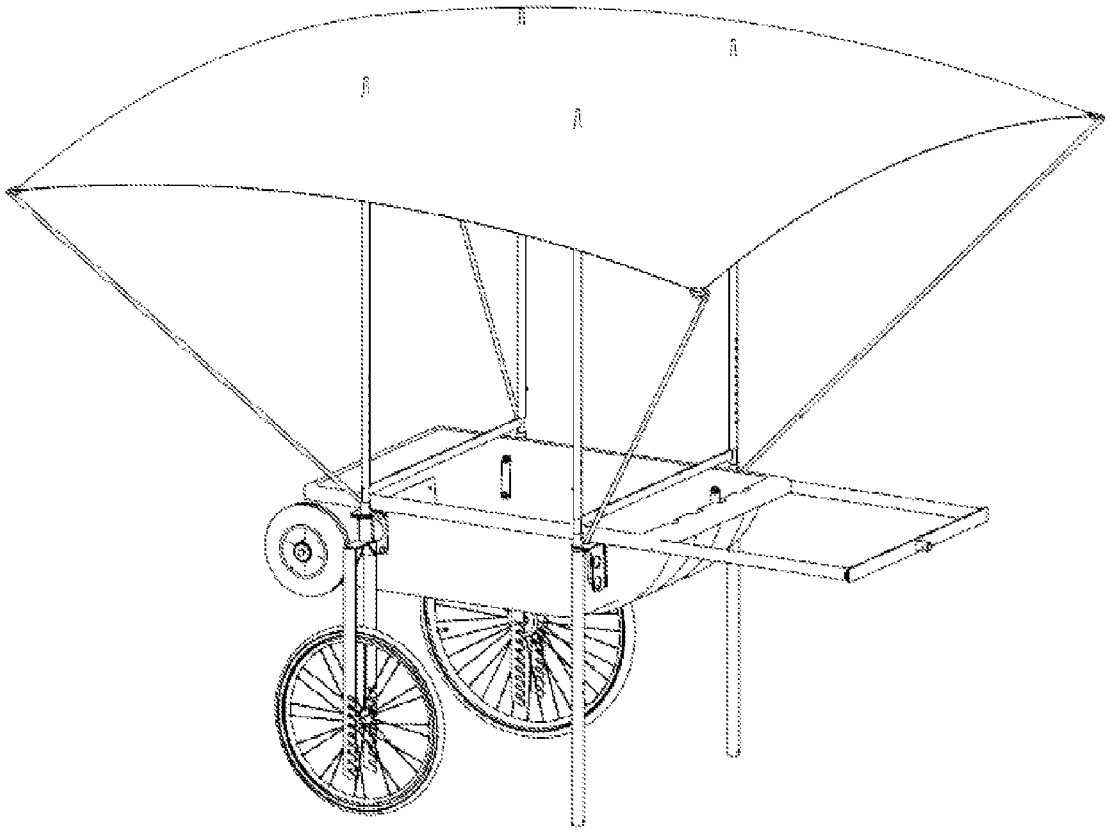
Figure 6F:
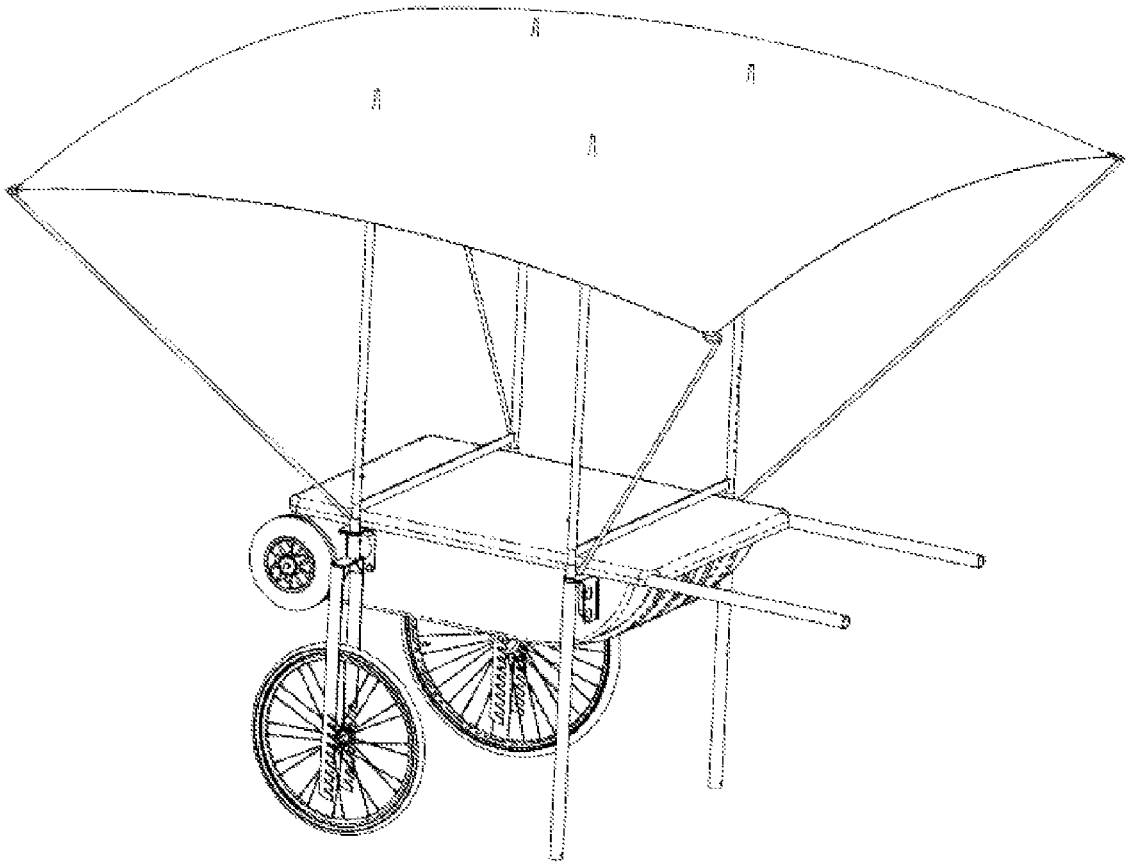
Figure 6G:
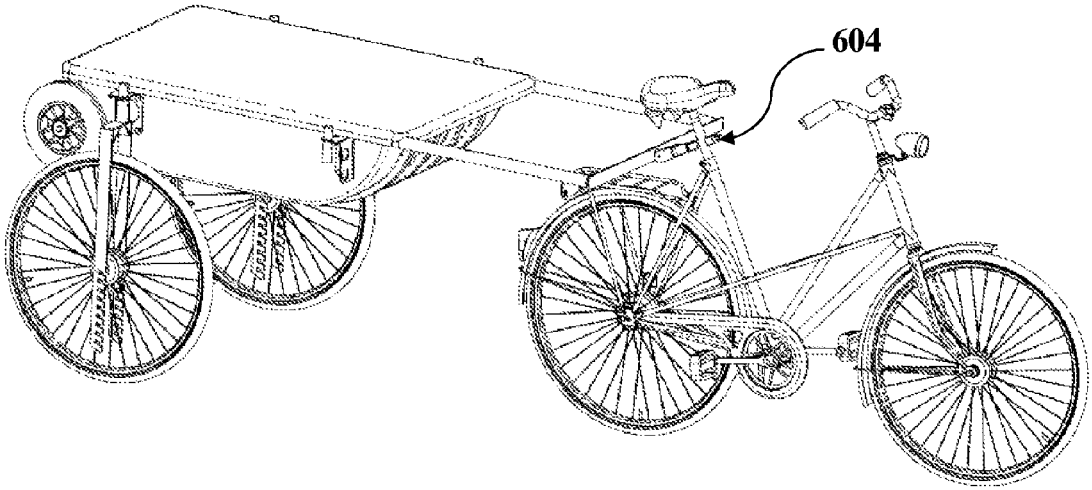
Figure 6H:
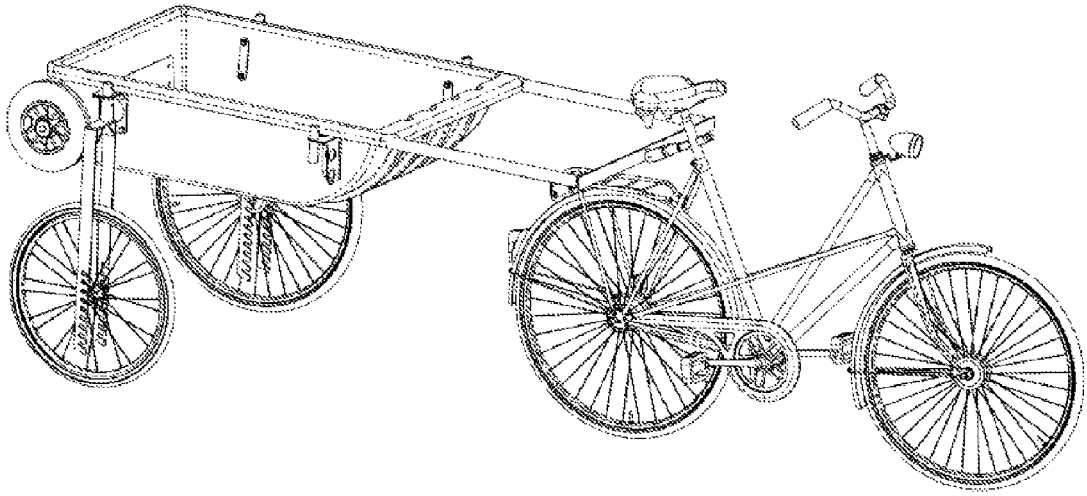
Figure 6I:
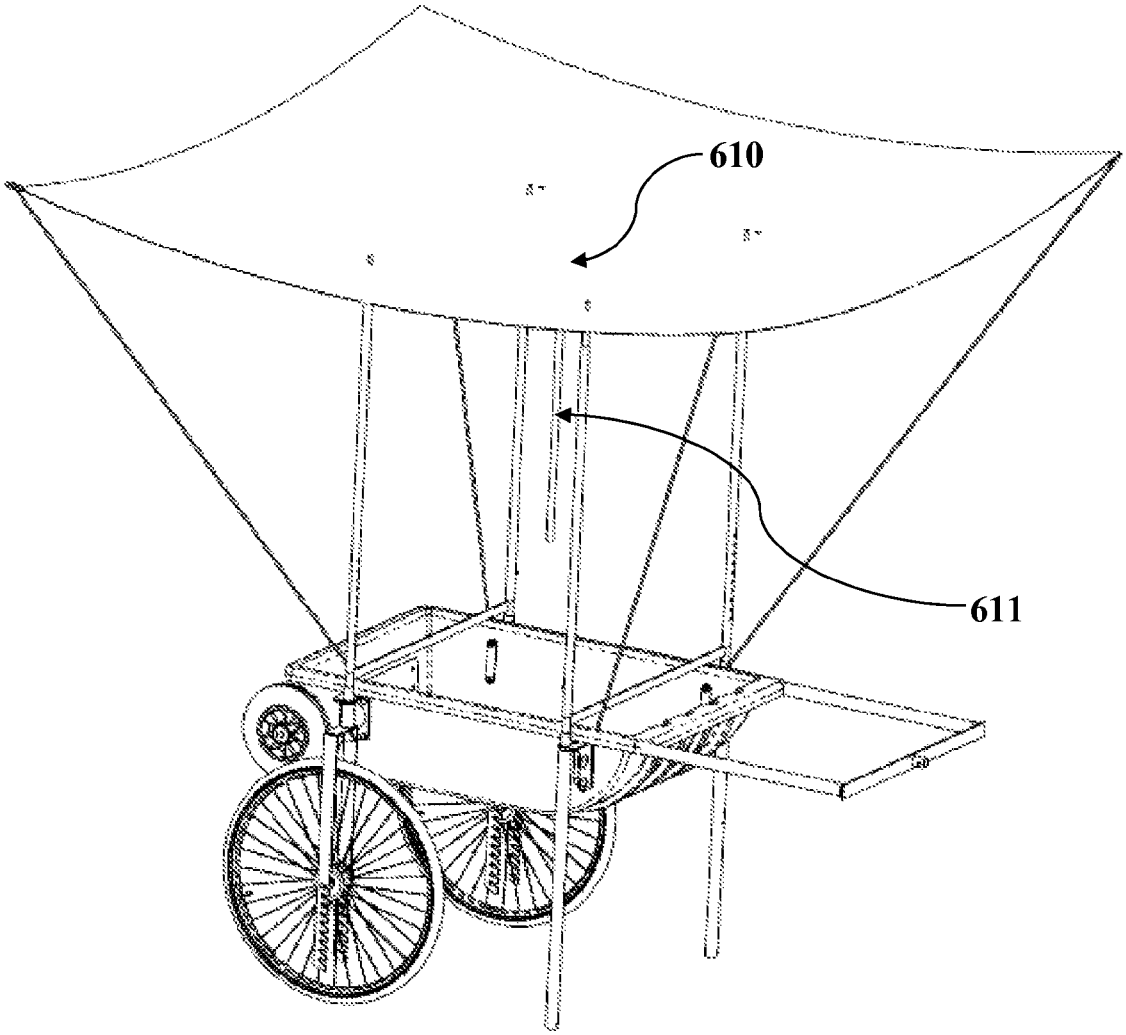
Figure 7A:
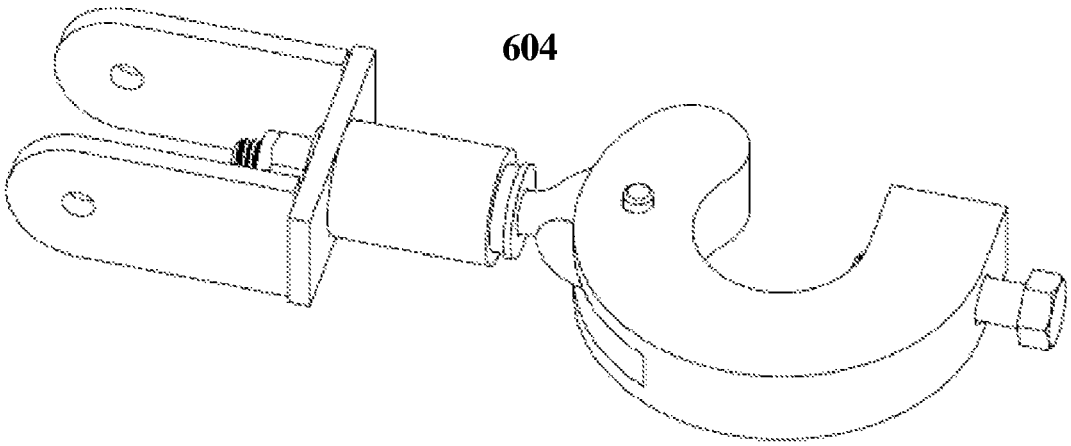
FIGS. 7A-7B illustrate a universal adapter for connecting the aid cart to a bicycle or vehicle as a trailer.
Figure 7B:
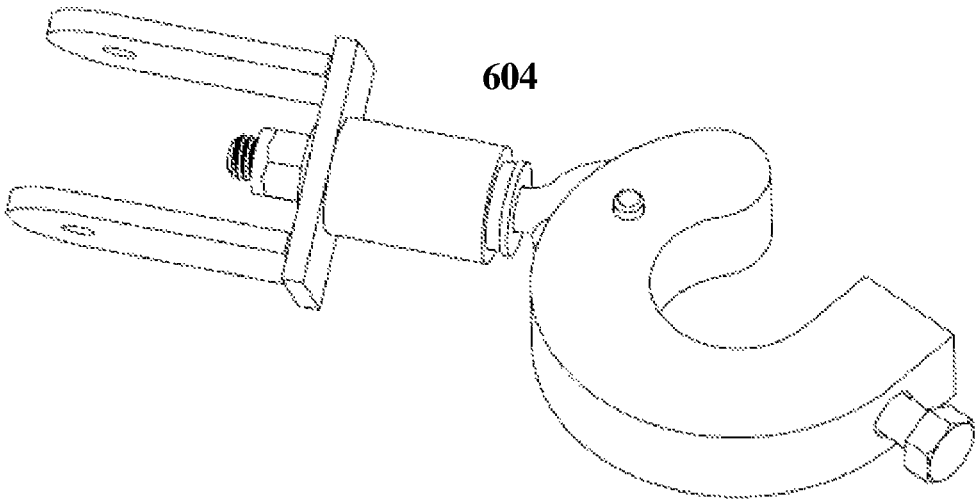

Cart 600 can be converted into a trailer using a universal adapter 604 as shown in FIGS. 6G-6H. Universal adapter 604, which is shown in more detail in FIGS. 7A-7B, is configured to connect to yoke bracket 603 and includes swivel joints to allow swiveling in vertical, horizontal, and rotational directions. Universal adapter 604 can be connected to a bicycle as shown in FIGS. 6G-6H or to another vehicle to allow cart 600 to be towed as a trailer. (brakes)

In some embodiments, canopy 402 can include an opening in or around the center. In such embodiments, canopy 402 can be used to collect water (e.g. rain water) by inverting canopy 402. For example, FIG. 61 illustrates canopy 402 being inverted on cart 600. Opening 610 in canopy 402 can include a valve, plug, or other means to selectively seal the opening to facilitate the draining of collected water from canopy 402 into another container. In some embodiments, a hose 611 can be attached to the opening to facilitate such draining.

Aid cart 100 can be used to store and transport virtually any supplies. In some embodiments, the contents of aid cart 100 can include a tent, a stove, blankets and/or sleeping bags, cooking and eating utensils, a water pump and container, a first aid kit, a tool kit, rope (including rope 403 and 404), a tarp (e.g. canopy 402), rain ponchos, and children's toys & games. To facilitate the storage of items, aid cart 100 can include one or more internal dividers or compartments. The dividers can be formed of any suitable material, and can be integrated, removable, interchangeable, segregable, reconfigurable, upgradeable, etc.

An aid cart 100 containing such contents can be purchased, supplied, or otherwise distributed to serve as a single unit storing essential emergency supplies which can be converted into the various configurations as described above to assist in a first responder aid, relief, or cleanup effort.

Further, aid cart 100 can also be used in non-emergency scenarios. For example, a mobile merchant can use aid cart 100 to conveniently store, transport, and display his or her goods for sale.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. An aid cart comprising:

a shell having a first side, a second side, a set of wheels, and a lid, the shell including a lip along a top edge of the first and second sides;

a plurality of tubes; and a first pair of hub brackets attached on the first side of the shell and a second pair of hub brackets attached on the second side of the shell, each hub bracket having at least one hole through which a tube can be inserted, each pair of hub brackets being aligned on the corresponding side of the shell so that one or more tubes can be stored along the surface of the shell by inserting each tube through a corresponding hole in each hub bracket of the pair of hub brackets, each of the hub brackets also being positioned to create an opening between the hub bracket and the lip into which the tubes can be inserted to form handles for the aid cart.

2. The aid cart of claim 1, wherein each hub bracket includes an adapter configured to allow any of the tubes to be attached to the adapter on either a top or a bottom end of the adapter.

3. The aid cart of claim 2, wherein each of the adapters and the tubes include corresponding holes through which a pin or other connector may be inserted to connect a tube to an adapter.

4. The aid cart of claim 2, wherein two tubes are attachable as handles on the end of the aid cart opposite the set of wheels, and tubes are attachable in an upward position to each of the adapters to form a bulk carrier.

5. The aid cart of claim 2, wherein tubes are attachable in a downward position to each of the adapters to form an elevated work area.

6. The aid cart of claim 5, further comprising a canopy assembly, the canopy assembly comprising telescoping tubes and a canopy, wherein the telescoping tubes are attachable in an upward position to each of the adapters to form adjustable supports for the canopy.

7. The aid cart of claim 6, wherein the canopy includes four holes through which the top end of the telescoping tubes are inserted.

8. The aid cart of claim 6, wherein the canopy assembly further includes a pair of shell support bars, and wherein the telescoping tubes are attached to the adapters using the pair of shell support bars, each shell support bar being configured to insert into an adapter and a telescoping tube connected to the top end of the shell support bar.

9. The aid cart of claim 6, wherein the inverted canopy includes an opening through which water collected in the canopy can be drained in a controlled manner.

10. The aid cart of claim 6, wherein the canopy assembly is configured to allow the canopy to be formed separate from the aid cart as a stand-alone unit.

11. The aid cart of claim 2, further comprising a pair of bicycle type forks that are configured to attach to the adapters in the same manner as the tubes, and a bracket for connecting together two tubes that are attached to the shell as handles to form a cart.

12. The aid cart of claim 11, wherein the bracket is configured to allow a universal adapter to be connected thereto on an opposite side from the handles to convert the cart into a trailer.

13. The aid cart of claim 11, wherein the bicycle type forks each include a plurality of notches at various heights to enable wheels of different diameters to be connected to the bicycle type forks.

14. The aid cart of claim 13, wherein the notches are spaced to allow wheels having diameters between 10 and 26 inches to be connected to the bicycle type forks.

15. The aid cart of claim 1, wherein the lip includes a hole proximate each corner of the shell for securing the tubes to the lip with a pin, or other retaining device, when the tubes are used as handles.

16. The aid cart of claim 15, wherein the lid includes holes that correspond to the holes in the lip to allow the lid to be secured to the lip using pins or other connectors.

17. The aid cart of claim 1, wherein two tubes are attachable as handles on the end of the aid cart opposite the set of wheels to form a wheeled cart.

18. The aid cart of claim 1, wherein a tube is attachable as a handle at each corner of the aid cart to form a two-person carrier.

19. The aid cart of claim 1, wherein the lid is lockable to the shell, and the aid cart is lockable to a structure.

20. The aid cart of claim 1, wherein the shell includes a drain plug.

21. A convertible aid cart comprising:

a shell having a sled shape, the shell having a set of wheels attached on one end, and a lip extending along a top edge of the sides;

a plurality of interchangeable tubes;

a pair of hub brackets attached on opposing sides of the shell, each pair of hub brackets being configured with corresponding holes for storing at least one of the interchangeable tubes, each hub bracket also including an adapter in a substantially vertical orientation, each adapter being configured on both the top and the bottom end to receive any of the interchangeable tubes, each of the hub brackets being positioned on the sides of the shell so that an opening is formed between the lip and the hub bracket into which any of the interchangeable tubes can be inserted to form a handle for the convertible aid cart.

22. The convertible aid cart of claim 21, wherein the adapters and the tubes include corresponding holes to allow for the insertion of a pin to connect a tube to an adapter, and wherein the lips and tubes also include corresponding holes to allow for the insertion of a pin to connect a tube to the bracket and the lip when the tube is secured within the opening formed between the lip and the corresponding hub bracket.

23. A convertible aid cart comprising:

a shell having a first side and a second side, the shell further having a set of wheels attached on one end, and a lip extending along a top edge of the first and second sides;

a plurality of interchangeable tubes;

a first pair of hub brackets attached on the first side of the shell; and a second pair of hub brackets attached on the second side of the shell;

wherein each hub bracket is positioned on the corresponding side to form an opening between the lip and the hub bracket into which any of the interchangeable tubes can be inserted to form a handle for the convertible aid cart, and wherein each hub bracket includes an adapter configured on both the top and the bottom end to receive any of the interchangeable tubes.

* * * * *